United States Patent [19]

Hardy

[11] 4,273,459

[45] Jun. 16, 1981

[54] SQUEEGEE DEVICE FOR LIQUID DISPENSING BOTTLE

[76] Inventor: Pierre J. Hardy, 4210 St. Denis St., Apt. #2, Montreal, Quebec, Canada, H2J 2K8

[21] Appl. No.: 960,083

[22] Filed: Nov. 13, 1978

[51] Int. Cl.[3] ..... A47L 1/08; A47L 13/03

[52] U.S. Cl. ..... 401/139; 401/137

[58] Field of Search ..... 401/137, 139; 15/245; 239/333, 289, 375; 222/383, 321, 324

[56] References Cited

U.S. PATENT DOCUMENTS

| | | | |
|---|---|---|---|
| 960,008 | 5/1910 | Evans et al. | 401/26 X |
| 1,151,100 | 8/1915 | Hicks | 401/25 |
| 2,753,578 | 7/1956 | Lebet | 401/139 |
| 3,002,699 | 10/1961 | Pinke | 239/333 |
| 3,061,202 | 10/1962 | Tyler | 239/333 |
| 3,110,052 | 11/1963 | Whitman | 15/245 X |
| 3,113,703 | 12/1963 | Rundle | 401/139 |
| 3,351,969 | 11/1967 | Cline | 401/139 X |
| 3,682,557 | 8/1972 | Simon et al. | 401/139 |

FOREIGN PATENT DOCUMENTS

| | | | |
|---|---|---|---|
| 989567 | 5/1976 | Canada | 401/139 |

*Primary Examiner*—Steven A. Bratlie

[57] ABSTRACT

A squeegee for use with a liquid dispensing bottle has a handle whose end is specially configured (i) for insertion between a liquid dispensing mechanism and the bottle, to be clamped when the mechanism is screwed down on the bottle and (ii) for orientation of the squeegee relative to the bottle and dispensing mechanism so that when the mechanism is screwed down on the bottle, the squeegee extends in a direction opposite to the fluid dispensing direction of the mechanism.

2 Claims, 4 Drawing Figures

SQUEEGEE DEVICE FOR LIQUID DISPENSING BOTTLE

The present invention is directed to a squeegee and more particularly to a squeegee device adapted to be mounted on a liquid dispensing bottle having a spray nozzle. The invention finds particular application for washing and cleaning car windows.

Frequently, a bottle of cleaning fluid is kept in the home or car or on garage forecourts. With luck a squeegee is somewhere near at hand so that windows or windshield, as the case may be, can be cleaned after being sprayed with fluid. Usually though, the bottle and the squeegee, being separate items, are to be found far apart and much time is wasted looking for one or the other.

It occurred to me that it would be of great convenience to physically combine a fluid dispensing bottle and a squeegee. Naturally this could be done during bottle manufacture but some buyers might want to apply fluid to surfaces which are not flat, so unsuited to squeegee use, or might prefer using a cloth to a squeegee.

A previous patent, Canadian Pat. No. 989,567, in my name sought to solve the problem by means of a squeegee attachable to a conventional, off-the-shelf design of liquid dispensing bottle. One such bottle has a hollow plunger projecting upwardly from the middle of the bottle top. The nozzle is depressed to produce a pressurized jet or spray of cleaning fluid laterally from a pinhole in the side of the plunger. The squeegee which I designed has a hollow handle whose end is a friction fit over the bottle top. To provide access for an operator's finger and an exit path for the cleaning fluid, I provided aligned arch-like cutouts in the handle wall. A squeegee blade was mounted or moulded into a channelled support at the other end of the handle, the blade thus being located more or less centrally above the bottle top. To use the bottle to dispense fluid the bottle is gripped by thumb, middle and ring finger and the index finger is inserted through one of the cutouts and pressed down to depress the plunger. In response to the plunger movement, fluid is expelled through the other cutout onto the window or windshield being cleaned. To use the squeegee, the hollow handle is gripped and the squeegee blade pressed against the windows and moved to scrape fluid across the window.

Two disadvantages were apparent in using a dispensing bottle having this type of squeegee adaptation. Firstly, a compromise was necessary between a large handle-bottle top contact area for sufficient friction to retain the squeegee in place and a small contact area to provide cutouts sufficiently large to facilitate index finger entry and fluid exit. In addition, when plugging the bottle top into the handle it was necessary to exercise great care to ensure that the spray orifice and a cutout were aligned.

With my presently proposed adaptation for a dispensing bottle, I seek to overcome these problems. I use a different type of dispensing bottle, this type having a trigger operated dispensing mechanism of gun-form. A feature of these gun-type dispensing mechanisms is that the trigger and the dispensing nozzle, although perhaps supported from a centrally located bottle neck, point in a specific direction and are offset to one side of the top of the bottle.

In its broadest aspect my presently proposed squeegee attachment has a handle or handle extension so formed that it utilizes a clamping interengagement between the dispensing mechanism and the bottle to be itself clamped, and moreover, it utilizes the non-symmetric nature of the dispensing mechanism to define a mounting direction which is substantially opposite to the fluid dispensing direction.

The invention will now be described by way of example with reference to the accompanying drawings in which.

Figure 1:
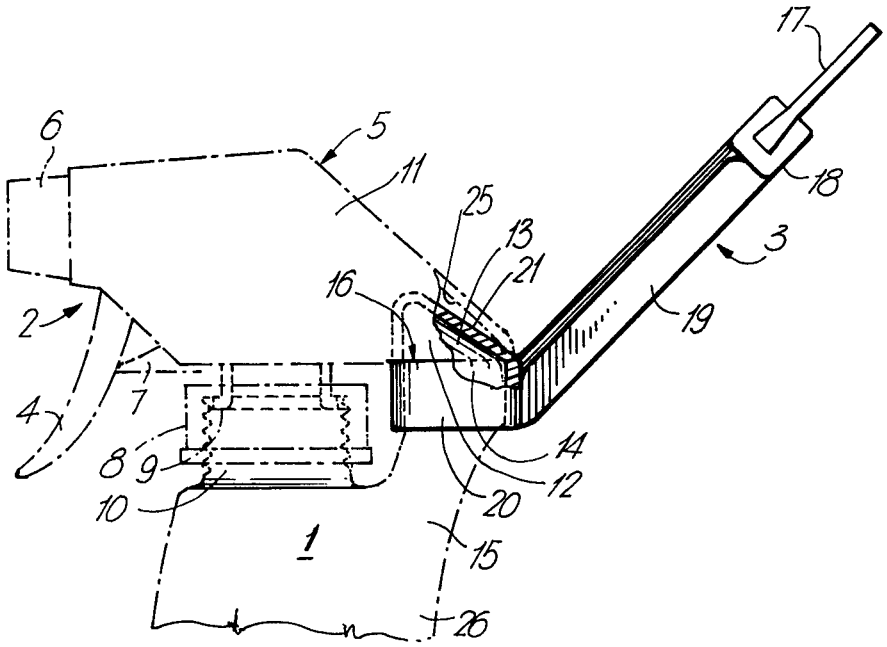
FIG. 1 is a longitudinal sectional view of the upper part of a bottle with a squeegee attachment, embodying the invention, attached to the bottle.

Referring to the drawings in detail, FIG. 1 shows a part of a liquid dispensing bottle 1, a trigger operated dispensing mechanism 2 and a squeegee 3.

The dispensing mechanism is of a known type in which, on pressing a trigger 4, fluid stored temporarily within a reservoir in a housing 5 is expelled as a jet or spray through the nozzle 6. On subsequently releasing the trigger 4, a charge of fluid is drawn up into the reservoir to be temporarily stored until the trigger is next pressed. Within the housing 5 are a number of interconnected flexible and semi-rigid tubes (not shown) which, in combination with the trigger 4 and a follower 7, are used to establish the pressure head and partial vacuum necessary both to dispense fluid as a jet from the nozzle and to suck fluid from the bottom of the bottle. The invention is applicable to other dispensing mechanisms having a gun-type action which are well known in the art.

At the base of the dispensing mechanism 2, a bottle cap 8 is suspended from an outwardly projecting flange 9 on the housing 5. The bottle cap 8 which is internally screw-threaded can thus be screwed down on an externally threaded bottle neck 10 without the dispensing mechanism 2 needing to be twisted.

At the rear of the housing 5 is a triangular part 11 formed with a skirt 12 shaped to fit snugly over a triangular ramp-form projection 13, itself an extension of a generally cuboid projection 14 on a shoulder 15 of the bottle 1. Engagement of the projection 13 within triangular part 11 prevents the dispensing mechanism 2 from revolving relative to the bottle 1 once the cap 8 has been screwed down. The lower edge of the skirt 12 locates against a ledge 16 marking the junction of the projections 13 and 14.

Figure 2:
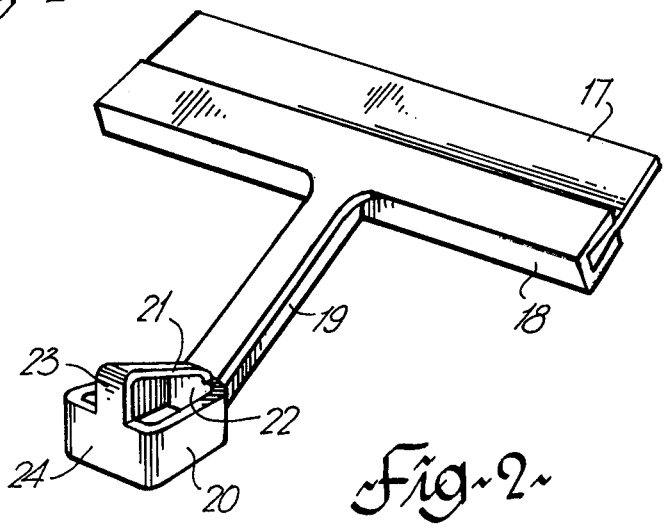
FIG. 2 is a perspective view of the squeegee attachment of FIG. 1.

Referring particularly to FIG. 2, the squeegee 3 has a flexible blade 17 clamped, or moulded, into a rigid plastics, channelled backing piece 18 having a handle 19. The end of the handle is formed so as to seat under the housing 5 against the bottle 1. To this end, a frame 20 is internally contoured to fit snugly around the projection 14, the skirt 12 being made of material sufficiently thick as to contact the frame 20 and to retain it against upward movement. A ramp 21 extends between one end or limb 22 of the frame and a strut 23 extending from an opposite end 24 of the frame. The ramp 21 fits against an upper face of the ramp-form projection 13. When the cap 8 is screwed into place, a rear face 25 of the housing sandwiches the ramp 21 against the projection 13 with the strut 23 hooked in front of the projection 13.

The elongate squeegee handle 19 extends rearwardly from the frame 20 making an angle of about 50° with the vertical.

The bottle 1 has a portion, 26, waisted to facilitate hand gripping. With forearm extending rearwardly—to the right in FIG. 1—the bottle is operated to dispense fluid. With forearm extending forwardly, the bottle is manipulated to apply the squeegee blade 17 to a surface to be cleaned of fluid.

Figure 3:
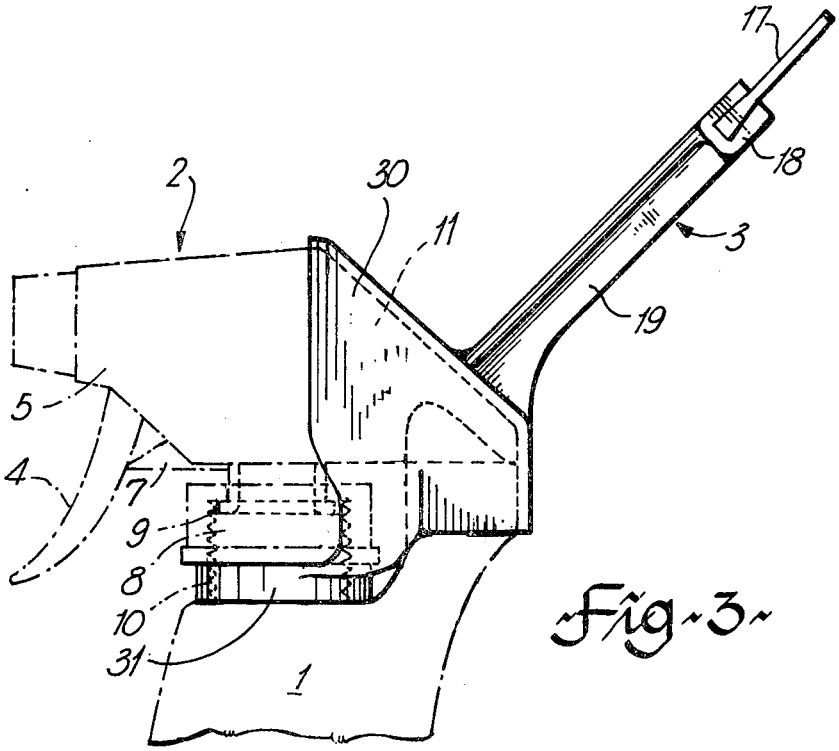
FIG. 3 is a longitudinal sectional view of the upper part of a bottle with an alternative squeegee attachment.
Figure 4:
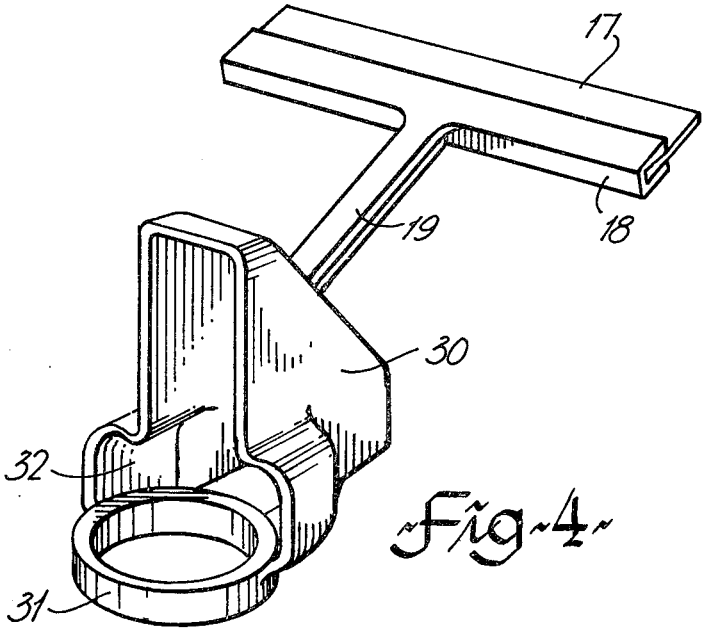
FIG. 4 is a perspective view of the squeegee attachment of FIG. 3.

The embodiments of FIGS. 3 and 4 is similar in many respects to that of FIGS. 1 and 2 and reference numerals of like features correspond.

Thus a liquid dispensing bottle 1 has a trigger operated dispensing mechanism 2 and a squeegee 3 mounted upon it. At the base of the mechanism, a screw cap 8 is suspended from an outwardly projecting flange 9 on a housing 5, the cap being screw engageable with a threaded neck 10 of the bottle. The housing, which has a rear triangular part 11, contains a number of interconnected flexible and semi-rigid tubes (not shown) which, in combination with a trigger 4 and a follower 7 are used to establish a pressure head and a partial vacuum as discussed with reference to FIG. 1.

The squeegee 3 has a flexible blade 17 mounted or moulded within a rigid channelled plastics piece 18 at one end of a handle 19. At the other end of the handle is a triangular cover-piece 30 shaped to fit closely over the housing 5, the inner surface configuration of, piece 30 being shaped to match that of the triangular part 11. Integral with the cover-piece is a circular frame 31 which fits snugly around the bottle neck 10. An open chamber 32 in the cover-piece provides a region in which the bottle cap 8 locates when the mechanism 2 is screwed down on the bottle, with the squeegee 3 clamped between the bottle cap 8 and the bottle 1.

In this embodiment, therefore, clamping of the squeegee takes place at the bottle cap junction while its mounting direction is established at the interengagement of the cover-piece 30 and the triangular housing 11. In the previous embodiment both clamping and mounting direction are determined in the region of the ramp-shaped projection 13.

This embodiment has a much larger "anchor" piece for the squeegee handle, so can be recommended for heavier duty applications such as, for example, cleaning windshields of frost.

In a related embodiment (not shown) the mounting direction and clamping are both determind at the cap-bottle junction, the dispensing mechanism, and the squeegee being rotated to their desired locations and the bottle cap being screwed tightly against the bottle neck to clamp both the frame at the end of the squeegee and the flange from which the cap is suspended.

What is claimed is:

1. A squeegee device for attachment to a fluid dispensing bottle, the fluid dispensing bottle having a trigger operated fluid dispensing mechanism, the fluid dispensing mechanism having retained thereon a screw-threaded cap, the cap being freely rotatable relative the fluid dispensing mechanism and being screw engageable about an axis with a screw-threaded neck of the bottle, the bottle having a projection locatable within a correspondingly shaped recess defined by a shaped skirt forming a part of the fluid dispensing mechanism, the projection and the recess spaced from said axis for preventing relative rotation of the bottle and the dispensing mechanism about the axis;

the squeegee device having a blade with a free flexible outer edge and a rigid inner edge, an elongate support member extending from the inner edge, said support member having a shaped portion including a substantially rectangular frame shaped to closely surround the projection and a clamping member extending from one part of the frame to another part of the frame and shaped to fit snugly around said projection and within the recess, the clamping member having a plate-like portion extending in a plane substantially perpendicular to a longitudinal axis of the support member, the clamping member insertable between the projection and the recess in a position in which the squeegee device extends in a direction substantially opposite to a fluid dispensing direction of said fluid dispensing mechanism, said shaped portion lockable in said position on said cap being screwed down on the neck of the bottle thereby preventing the squeegee device from twisting about said axis.

2. A squeegee device for attachment to a fluid dispensing bottle, the fluid dispensing bottle having a trigger operated fluid dispensing mechanism, the fluid dispensing mechanism having retained thereon a screw threaded cap, the cap being freely rotatable relative the dispensing mechanism and being screw engageable about an axis with a screw-threaded neck of the bottle, the bottle and a rear part of the dispensing mechanism having cooperating anchor means spaced from the axis for preventing relative rotation of the bottle and the dispensing mechanism about the axis;

the squeegee device having a blade with a free flexible outer edge and a rigid inner edge, an elongate suport member extending from the inner edge, said support member having a hollow shaped end portion interfitting with the rear part of said fluid dispensing mechanism in a position in which the squeegee device extends in a direction substantially opposite to a fluid dispensing direction of said fluid dispensing mechanism, the shaped end portion and the rear part of said fluid dispensing mechanism including abutting planar wall portions extending in a plane substantially perpendicular to a longitudinal axis of the support member, said shaped portion having integral therewith a circular frame locatable around the neck of the bottle, the cap being screwed down on the neck to lock the circular frame against the bottle whereby to prevent the squeegee device from becoming detached from the bottle, and to lock the shaped portion in said position whereby to prevent the squeegee device from twisting about said axis.

* * * * *